US007758009B1

(12) United States Patent
Chang

(10) Patent No.: US 7,758,009 B1
(45) Date of Patent: Jul. 20, 2010

(54) FULL FOLDING/UNFOLDING BOOK STAND AND COPY HOLDER

(76) Inventor: Chun-Yuan Chang, P.O. Box 44-2049, Taipei (TW) 10668

( * ) Notice: Subject to any disclaimer, the term of this patent is extended or adjusted under 35 U.S.C. 154(b) by 0 days.

(21) Appl. No.: 12/457,524

(22) Filed: Jun. 15, 2009

(51) Int. Cl.
*A47B 97/04* (2006.01)

(52) U.S. Cl. ..... 248/460; 248/453; 248/454; 248/456

(58) Field of Classification Search ..... 248/460, 248/462, 463, 464, 465, 453, 447, 451, 454, 248/455, 456; D14/447; D6/311
See application file for complete search history.

(56) References Cited

U.S. PATENT DOCUMENTS

| | | | | | |
|---|---|---|---|---|---|
| 756,486 | A * | 4/1904 | Fleming | ..... | 248/456 |
| 1,203,659 | A * | 11/1916 | Smith | ..... | 248/456 |
| 2,591,170 | A * | 4/1952 | Levinson et al. | ..... | 248/456 |
| 2,792,668 | A * | 5/1957 | Gallamos | ..... | 248/456 |
| 3,460,795 | A * | 8/1969 | Dahlin | ..... | 248/452 |
| 5,366,197 | A * | 11/1994 | Westland | ..... | 248/456 |
| 5,451,025 | A * | 9/1995 | Hames | ..... | 248/456 |
| 5,492,299 | A * | 2/1996 | Thermos et al. | ..... | 248/453 |
| 5,765,799 | A * | 6/1998 | Weber | ..... | 248/453 |
| 6,971,622 | B2 * | 12/2005 | Ziegler et al. | ..... | 248/454 |
| 2006/0186303 | A1 * | 8/2006 | Phifer et al. | ..... | 248/454 |

* cited by examiner

*Primary Examiner*—Anita M King
(74) *Attorney, Agent, or Firm*—Banger Shia

(57) ABSTRACT

The present invention provide a full folding/unfolding book stand and copy holder, which components are connected in one piece, so that it can be well connected when folding or unfolding; its strong triangular movable support components on the back can be adjusted for different angles when used, so that it is portable and convenience for use at various locations and thickness of books.

3 Claims, 6 Drawing Sheets

FULL FOLDING/UNFOLDING BOOK STAND AND COPY HOLDER

BACKGROUND OF THE INVENTION

1. Field of the Invention

The present invention relates generally to a book stand and copy holder, and more particularly to a book stand and copy holder which is portable for use at different locations, and is supported by strong triangular movable parts to be adjusted for different inclining angles according to the thickness of the books and users' needs.

2. Description of the Prior Art

The common book stands are generally categorized into fixed and portable ones, of which the fixed ones are robust and used for permanent placement of massive books without flexibility; the commonly-used portable ones are lightweight but damageable and non-durable, making it impossible to support the massive books.

SUMMARY OF THE INVENTION

The objective of the present invention is to use light and portable one-piece structure to compose the book stand and copy holder so that it is convenient for folding and unfolding, and can be used at different places or locations. It is portable outdoor and can be used anywhere.

The other objective of the present invention is to provide multi-segment supporting structure at the back of the book stand and copy holder, so that it can form different inclining angles accordingly. The other objective of the present invention is to provide a triangular supporting structure at the back of the book stand and copy holder, in conjunction with the multi-segment movable design, so that it can be adjusted at different inclining angles in response to different books and user habits.

DETAILED DESCRIPTION OF THE PREFERRED EMBODIMENTS

The features and the advantages of the present invention will be more readily understood upon a thoughtful deliberation of the following detailed description of a preferred embodiment of the present invention with reference to the accompanying drawings.

Figure 1:
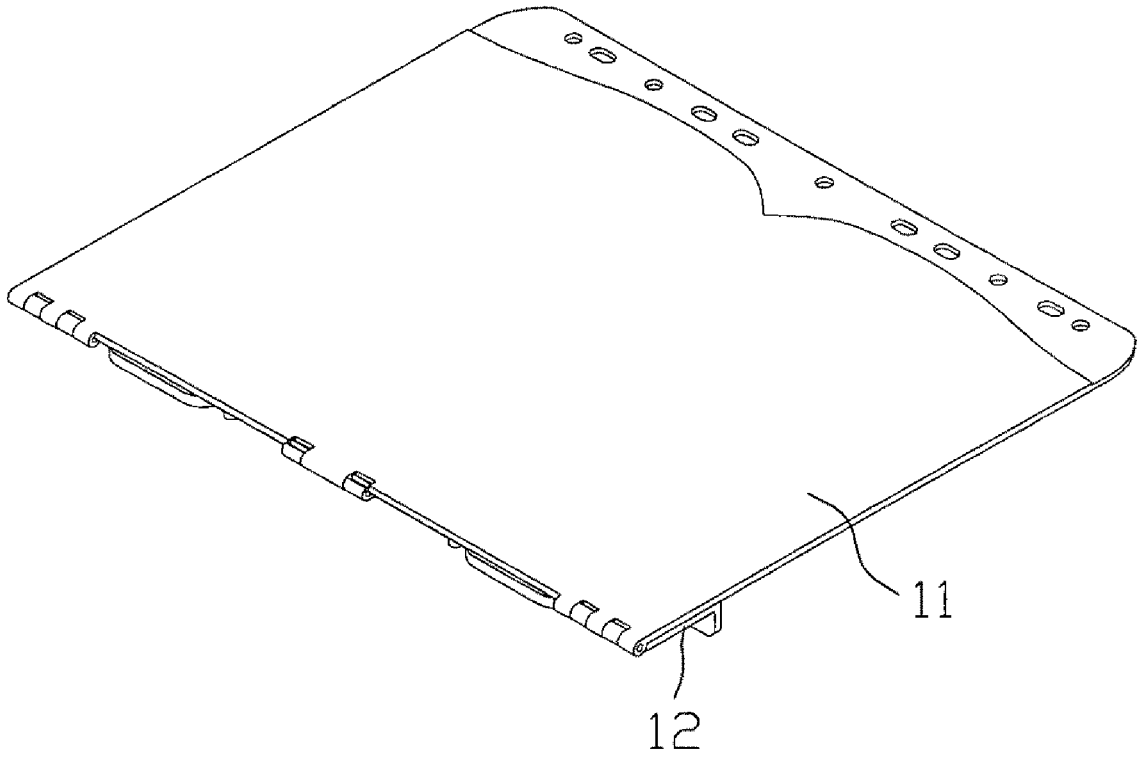
FIG. 1 shows the operational diagram of present invention when unfolded.
Figure 2:
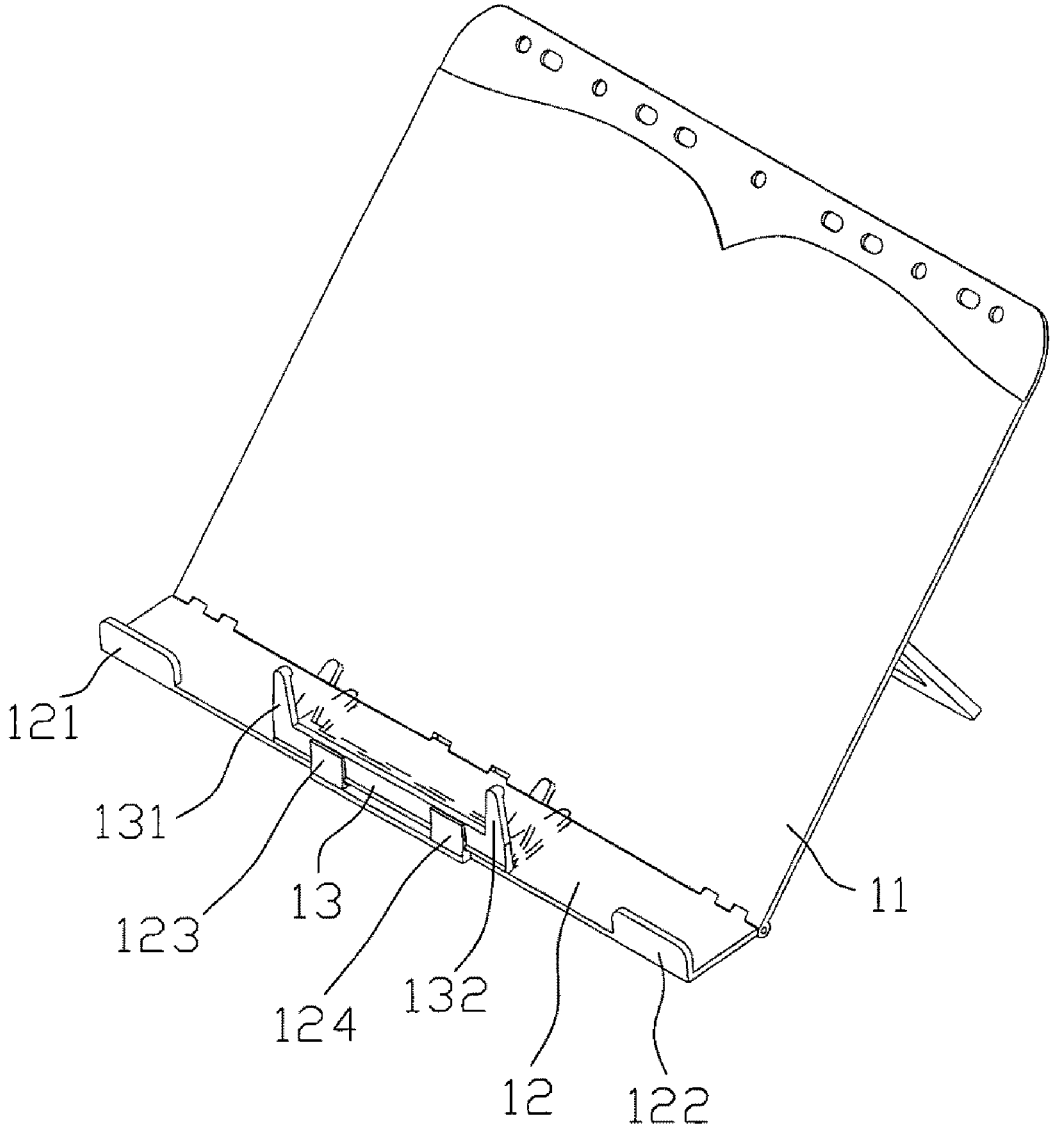
FIG. 2 shows the frontal view of the present invention when unfolded and standing.

Referring to FIGS. 1 and 2, the present invention comprises a main body 11 and its lower folded panel 12 that form the front placement of books, and the two front sides of said panel 12 form fixed panels 121, 122, between which two retainer 123, 124 are fixed, and a central movable supporting panel 13, and two sides of the movable supporting panel 13 protrude to be two pressing bars 131, 132.

Figure 3:
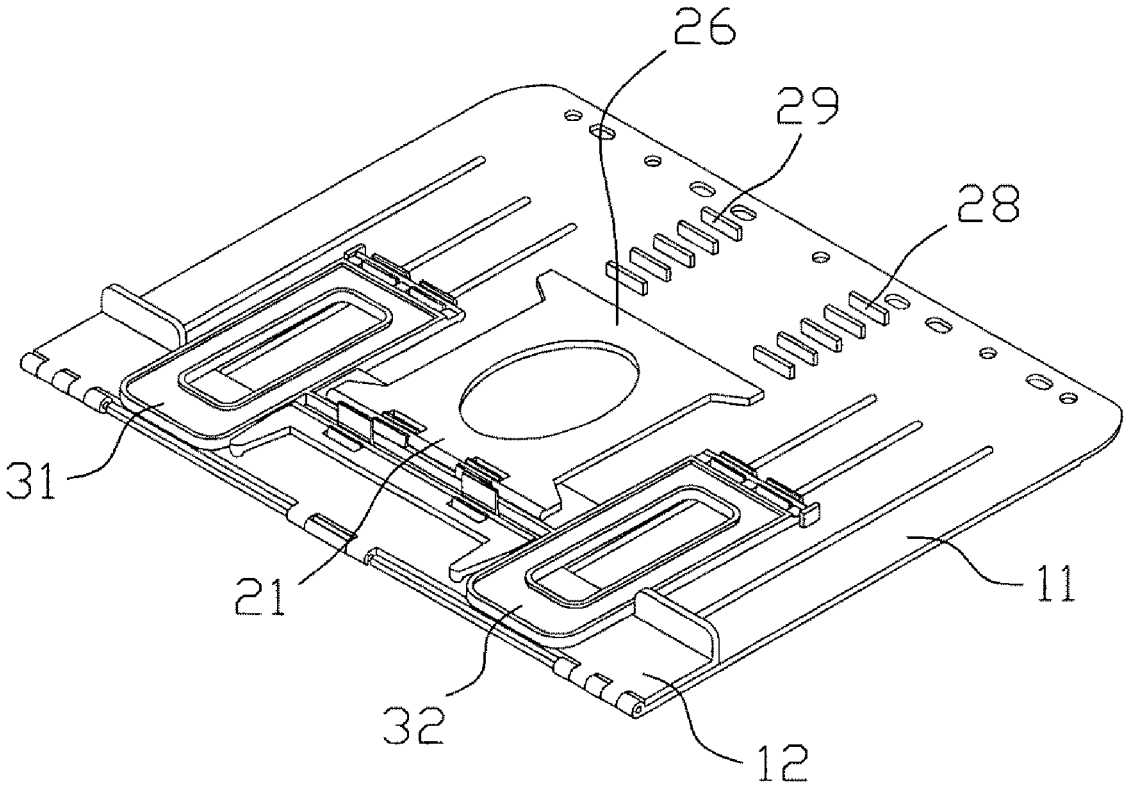
FIG. 3 shows the rear view of the present invention when folded.
Figure 4:
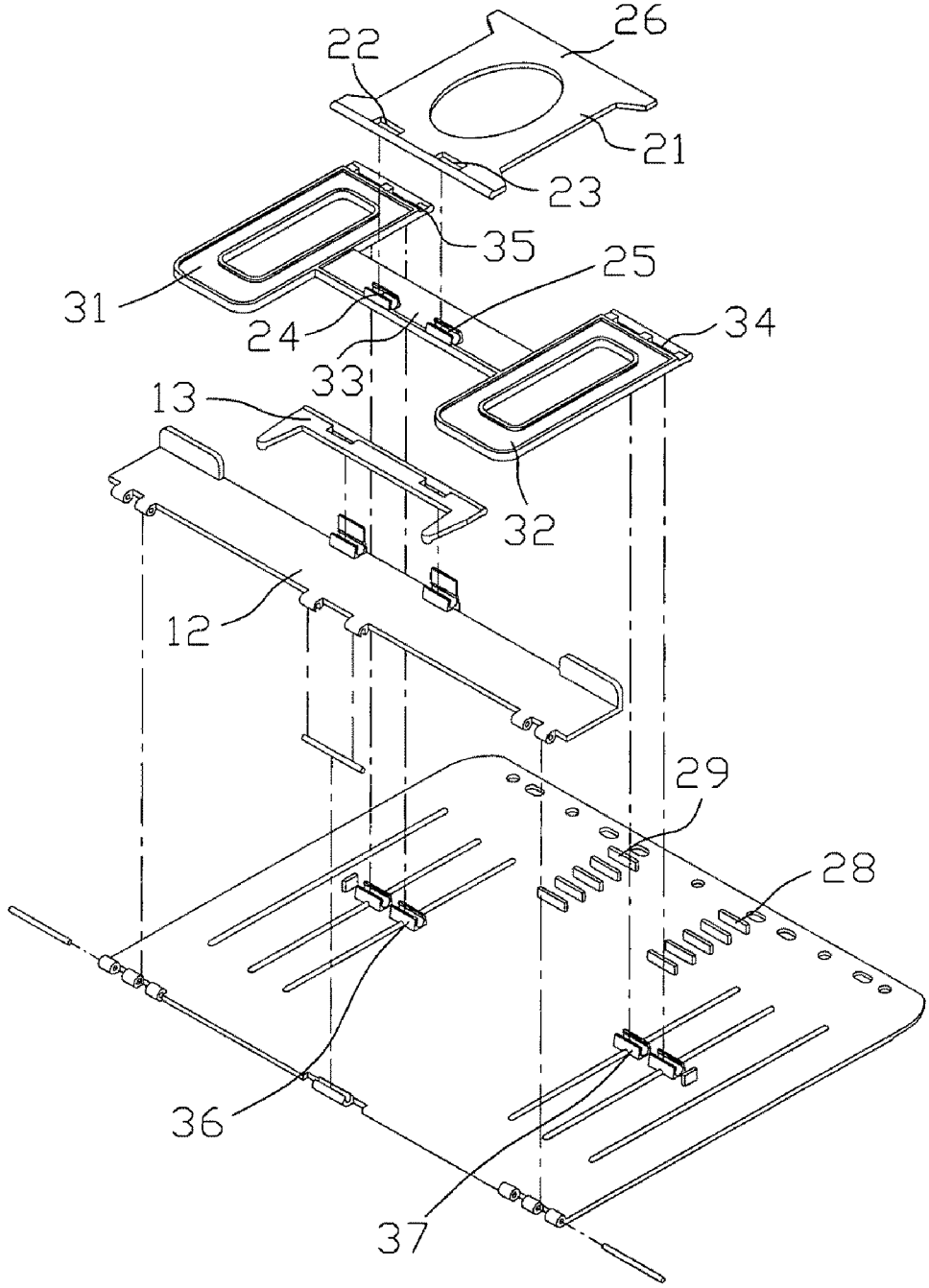
FIG. 4 shows the assembled view of the back supporting component of the present invention.

Referring to FIGS. 3 and 4, the back of the main body 11 comprises a folded panel 12, supporting panel 21 and supporting stands 31 32; among which, said panel 21 has fastening holes 22 23 on the lower side to be fastened to the positioning blocks 24 25, as in a movable state, so that its upper side 26 can be fastened to any of the multi-level positioning blocks 28 29 on the back of the main body; the two supporting stands 31 32 are connected to the central panel 33 as one piece, and the fastening holes 34 35 on its upper side can be fastened to the positioning blocks 36 37, so as to be unfolded and form the main supporting component of the main body 11.

Figure 5:
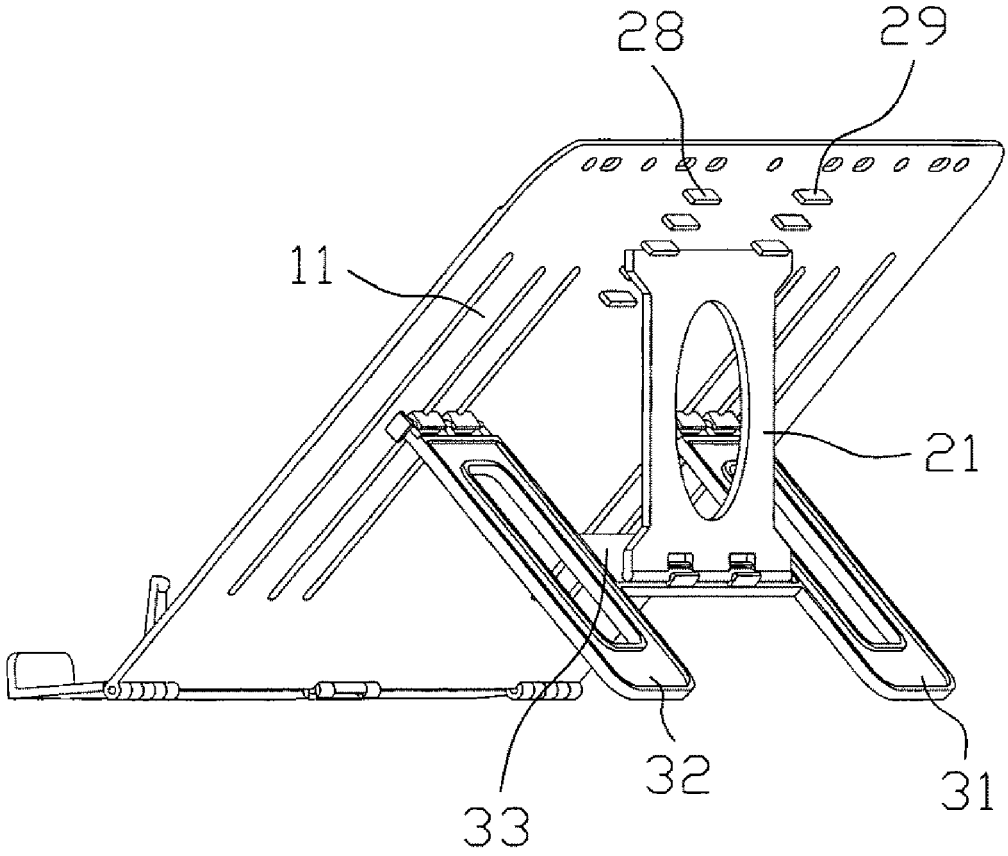
FIG. 5 shows the rear view of the present invention when standing.

Based upon the above structure, referring to FIG. 5, when two stands 31 32 are extended, the supporting panel 21 on the central panel 33 can be lifted upward so that the upper side 26 can be fastened to any of the multi-level positioning blocks 28 29, so as to form the unfolding state for use.

Figure 6:
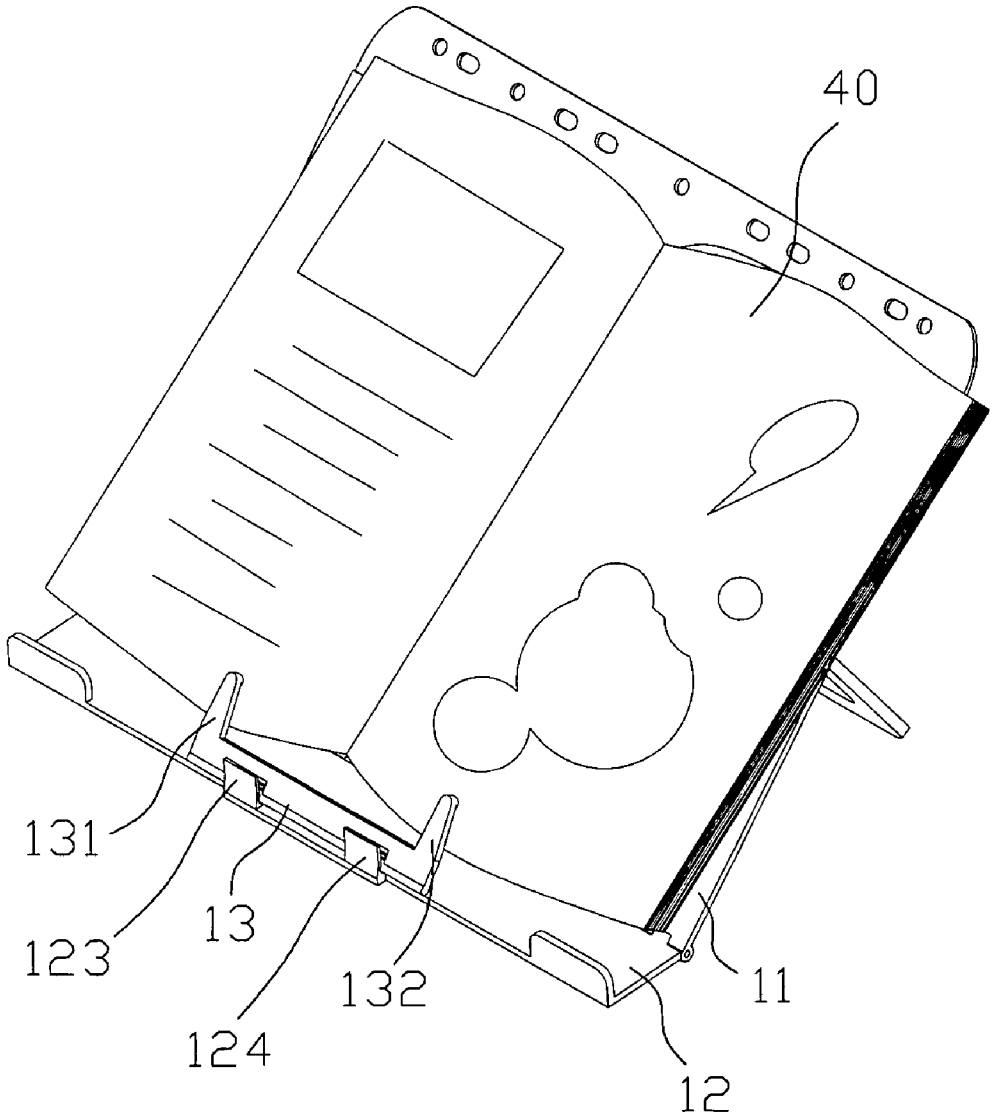
FIG. 6 shows the operational view of the present invention.

Referring to FIG. 6, when the book stand and copy holder is unfolded, books 40 can be placed on the front side of the main body 11, the movable panel 13 has two pressing bars 131 132, which can press over the pages of the two inward for readers' convenience.

What is claimed is:

1. A full folding/unfolding book stand comprising a main body including a folded panel connected to a lower end thereof and a central movable supporting panel disposed on the folded panel, the folded panel having two fixed panels formed on two front sides thereof respectively and two retainers fixed between the fixed panels thereof, and the movable supporting panel having two pressing bars integrally formed with the central movable supporting panel;

the main body also including a supporting panel and two supporting stands all disposed on a back side thereof;

a central panel including two sides connected to the two supporting stands respectively on the back side of the main body as one piece and two first positioning blocks used to fasten two first fastening holes of the supporting panel to form main supporting components of the main body;

wherein the main body further includes at least one multi-level positioning block secured on an upper end of the back side thereof to fasten an upper side of the main body to the supporting panel, and two second positioning blocks disposed on the back side thereof;

wherein the supporting panel has the first two fastening holes arranged on a lower side thereof to be fastened to the two first positioning blocks of the central panel respectively, the two support stands have two second fastening holes arranged on upper sides thereof individually so as to be fastened to the second positioning blocks of the main body respectively.

2. The full folding/unfolding book stand defined in claim 1, wherein when the two support stands are extended, the supporting panel on the central panel is lifted upward so that the upper side of the supporting panel is adjustably fastened to the multi-level positioning blocks.

3. The full folding/unfolding book stand defined in claim 1, wherein a front side of the main body is used to place books and the two pressing bars of the movable supporting panel are pressed toward the books, as the book stand is unfolded.

* * * * *